US005701145A

United States Patent [19]

Ninomiya

[11] Patent Number: 5,701,145

[45] Date of Patent: Dec. 23, 1997

[54] INK JET RECORDING METHOD AND APPARATUS WITH CONTROL OF RETRACTING AND CAPPING RESPONSIVE TO AMOUNT RECORDING MEDIUM IS TO BE CONVEYED

[75] Inventor: Takayuki Ninomiya, Ichikawa, Japan

[73] Assignee: Canon Kabushiki Kaisha, Tokyo, Japan

[21] Appl. No.: 483,972

[22] Filed: Jun. 7, 1995

Related U.S. Application Data

[63] Continuation of Ser. No. 41,891, Apr. 2, 1993, abandoned, which is a continuation of Ser. No. 711,989, Jun. 7, 1991, abandoned.

[30] Foreign Application Priority Data

Jun. 12, 1990 [JP] Japan ..... 2-154683

[51] Int. Cl.[6] ..... B41J 2/165

[52] U.S. Cl. ..... 347/23; 347/32

[58] Field of Search ..... 347/19, 23, 29, 347/32, 37, 104, 101

[56] References Cited

U.S. PATENT DOCUMENTS

| | | | |
|---|---|---|---|
| 3,925,789 | 12/1975 | Kashio | 347/23 |
| 4,362,572 | 12/1982 | Wallace | 134/18 |
| 4,723,129 | 2/1988 | Endo et al. | 347/56 |
| 4,740,796 | 4/1988 | Endo et al. | 347/56 |
| 4,967,204 | 10/1990 | Terasawa et al. | 349/23 |

FOREIGN PATENT DOCUMENTS

| | | |
|---|---|---|
| 3633239 | 4/1987 | Germany . |
| 55-082660 | 6/1980 | Japan . |
| 57-105376 | 6/1982 | Japan . |
| 60-217165 | 10/1985 | Japan . |
| 63-132058 | 6/1988 | Japan . |
| 2210586 | 6/1989 | United Kingdom . |

*Primary Examiner*—David F. Yockey

*Attorney, Agent, or Firm*—Fitzpatrick, Cella, Harper & Scinto

[57] ABSTRACT

An ink jet recording method and apparatus for performing recording on a recording medium include a recording head for performing recording on the recording medium; a conveyor for conveying the recording head; and a device for discriminating the amount the recording medium is to be conveyed relative to the recording head to cause the recording means to be retracted to the outside of the recording area in accordance with the result of such discrimination.

31 Claims, 6 Drawing Sheets

INK JET RECORDING METHOD AND APPARATUS WITH CONTROL OF RETRACTING AND CAPPING RESPONSIVE TO AMOUNT RECORDING MEDIUM IS TO BE CONVEYED

This application is a continuation of application Ser. No. 08/041,891 filed Apr. 2, 1993, now abandoned, which is a continuation of application Ser. No. 07/711,989, filed Jun. 7, 1991, abandoned.

BACKGROUND OF THE INVENTION

1. Field of the Invention

The present invention relates to an ink jet recording apparatus for performing its recording by discharging ink onto a recording medium.

2. Related Background Art

Conventionally, the recorder which performs recordings on papers, OHP sheets, and other recording media (hereinafter referred to as recording paper or simply as paper) has been proposed in a configuration that the recorder is equipped with a recording head of various methods. For the recording head, a wire dot recording method, thermosensitive recording method, thermal transfer recording method, ink jet recording method, and others are in use.

Of these methods, the ink jet recording method is particularly the one on which more interest is focused as a quiet method operable at a low running cost because of its direct ink discharging onto the recording paper.

In a recorder with such ink jet recording method, a head having an array of fine discharging ports is generally employed as its recording head. Therefore, if the recording head is left unused for a long time, the head presents itself a state where ink becomes unsuitable for a proper discharging due to the mixture of bubbles or dusts in the inside of the discharging ports or due to the increased viscosity caused by the evaporation of ink solvent.

Also, it is generally in practice that the recording medium is fed (hereinafter referred to as paper feeding) when the head is at rest, and the head is relatively carried to the next position to start recording. If this paper feeding continues, dusts such as paper particles tend to be generated, resulting in lowering the recording performance of the recording head. These dusts float in the air and adhere to the discharging ports and others of the recording head, which tends to cause the recording head to perform its ink discharging defectively.

In order to protect the recording head from becoming incapable of discharging ink properly, capping is generally in practice. This capping is usually performed in such a manner that a cap which can cover the discharging port formation surface is arranged in a region outside the recording area, and that the discharging port formation surface is covered by this cap when the recording head is not in operation.

To carry out this capping, it is necessary to retract the recording head to a location outside the recording area so that the cap is in contact with the recording head. Therefore, it should inevitably bring about an increase in the recording time if the capping is carried out whenever the recording head is not in operation.

To counteract this, the retraction of the recording head is designed as shown in FIG. 1, in which the number of the paper feeding pulses is that of the driving pulses of a conveying motor which corresponds to the volume of the paper feeding.

Here, the recording head remains within the recording area until a first time $t_1$ subsequent to the termination of the recording, and if the recording operation is resumed within this period of time, the recording will continue. However, if no recording operation is resumed within such period of time, the recording head will be conveyed to a standby position outside the recording area. In FIG. 1, a reference mark $tw_1$ designates the time required for this conveyance of the recording head. There is no need for the recording head to retract to such standby position as far as the recording is continuously carried out within the aforesaid first period of time $t_1$. It is therefore possible to save the time required for such retraction of the recording head and obtain the fastest recording speed.

Also, if the recording operation is resumed within the second period of time $t_2$ while the recording head stays at the standby position, the recording will continue without conducting any capping operation. However, if no recording operation is resumed then, the capping operation will be conducted subsequent to having conveyed the recording head from the standby position to the capping position. In FIG. 1, a reference mark $tw_2$ shows the time required for operation. If the recording operation is resumed within the period of time $t_2$, the time required for the capping is saved. It is possible to prevent slowing down the recording speed and at the same time, to reduce the amount of paper particles to adhere because the recording head has been retracted to the standby position outside the recording area.

FIG. 2 is a view showing the rotational control in a case where a pulse motor is employed as the conveying motor 35 for the paper feeding. FIG. 2 represents a ramp up—ramp down control of the motor, whereby its rotation is gradually increased at the starting time and becomes constant at high speeds (ramp up) and when the motor is stopped at a constant speed, the rotation is gradually decreased (ramp down).

Here, the reason why the inclination of the graphed line is different at a point A in FIG. 1 is that the pulse motor 35 for feeding the paper performs its self-actuation before it reaches the point A as its driving method. Here the self-actuation means a method thereby rotating the pulse motor 35 at a constant speed at all times without any ramp up—ramp down control for higher rotations as shown in FIG. 2. Therefore, it is impossible to obtain high-speed rotations, requiring a considerable amount of time to feed the paper.

In the above-mentioned ink jet recording apparatus, the recording head remains within the recording area (on the paper) for the first period of time $t_1$ until the recording head is retracted to the standby position outside the recording area unless the paper feeding time after the recording exceeds the aforesaid first period of time $t_1$. As a result, the recording head remains on the recording paper which is being fed during the first period of time $t_1$, and there is a higher possibility that the dusts of paper particles floating in the air and others adhere to the recording head. Also, in a case where fan fold papers are used, there is a possibility that the perforated portions thereof are in contact with the recording head when the folded papers are being fed to allow such portion to be stained with ink.

Here, the paper feeding is actuated when the operation of the recording head is stopped or immediately before it is stopped for the non-operational period thereof after recording. Therefore, if the paper feeding time subsequent to the recording exceeds the first period of time $t_1$, the paper feeding is temporarily suspended and the recording head is conveyed to the standby position. It is then necessary to resume the paper feeding after the recording head has retracted. This results in slowing down the total recording speed.

Also, if the paper feeding time after the recording exceeds the sum of the aforesaid first and second periods of time, the recording head should first be retracted to the standby position when the first period of time $t_1$ has elapsed; then the recording head should further be retracted to the capping position at the time $t_3$ after the second period of time $t_2$ has elapsed at the standby position. Then, subsequent to this further retraction of the head, the capping is carried out. Accordingly, the paper feeding is interrupted twice following the head conveyance which has been performed twice. Hence the total recording speed is further slowed down.

As set forth above, there is a possibility in operating the aforesaid ink jet recording apparatus that the recording head is adversely affected by the adhesion of the dusts of paper particles and others in the course of paper feeding, and the ink discharging becomes defective, or there is a disadvantage that the recording speed is slowed down due to the increase amount of time required for paper feeding.

SUMMARY OF THE INVENTION

An object of the present invention is to provide an ink jet recording apparatus capable of preventing the slowdown of its recording speed.

Another object of the present invention is to provide an ink jet recording apparatus capable of improving its recording speed.

Still another object of the present invention is to provide an ink jet recording apparatus capable of improving its system reliability.

Still another object of the present invention is to provide an ink jet recording apparatus capable of improving its recording quality.

A further object of the present invention is to provide an ink jet recording apparatus capable of preventing the defective discharging of ink from its discharging ports.

Still a further object of the present invention is to solve the aforesaid problems and provide an ink jet recording apparatus capable of preventing the defective discharging of its recording head and the slowdown of its recording speed.

DETAILED DESCRIPTION OF THE PREFERRED EMBODIMENT

Subsequently, an ink jet recording apparatus, to which an embodiment suited for the present invention is applied, will be described.

The embodiment set forth below has a computing means for computing the conveying volume or time required for conveying a recording medium relatively to the recording head in a state where ink is not discharged from the recording head, and a controlling means for controlling the retractive operation of the above-mentioned recording head to the outside of the recording area based on the conveying volume computed by this computing means.

According to the present embodiment, the retraction of the recording head to the outside of the recording area is controlled by the controlling means in accordance with the above-mentioned conveying volume or time. Consequently, there is no possibility of slowing down its recording speed due to any unnecessary retractive operations thereof. It is also possible to prevent the defective discharging of ink caused by the dusts of paper particles and others.

Hereinafter, in reference to the accompanying drawings, the embodiment of ink jet recording apparatus according to the present invention will be described in detail.

Figure 3:
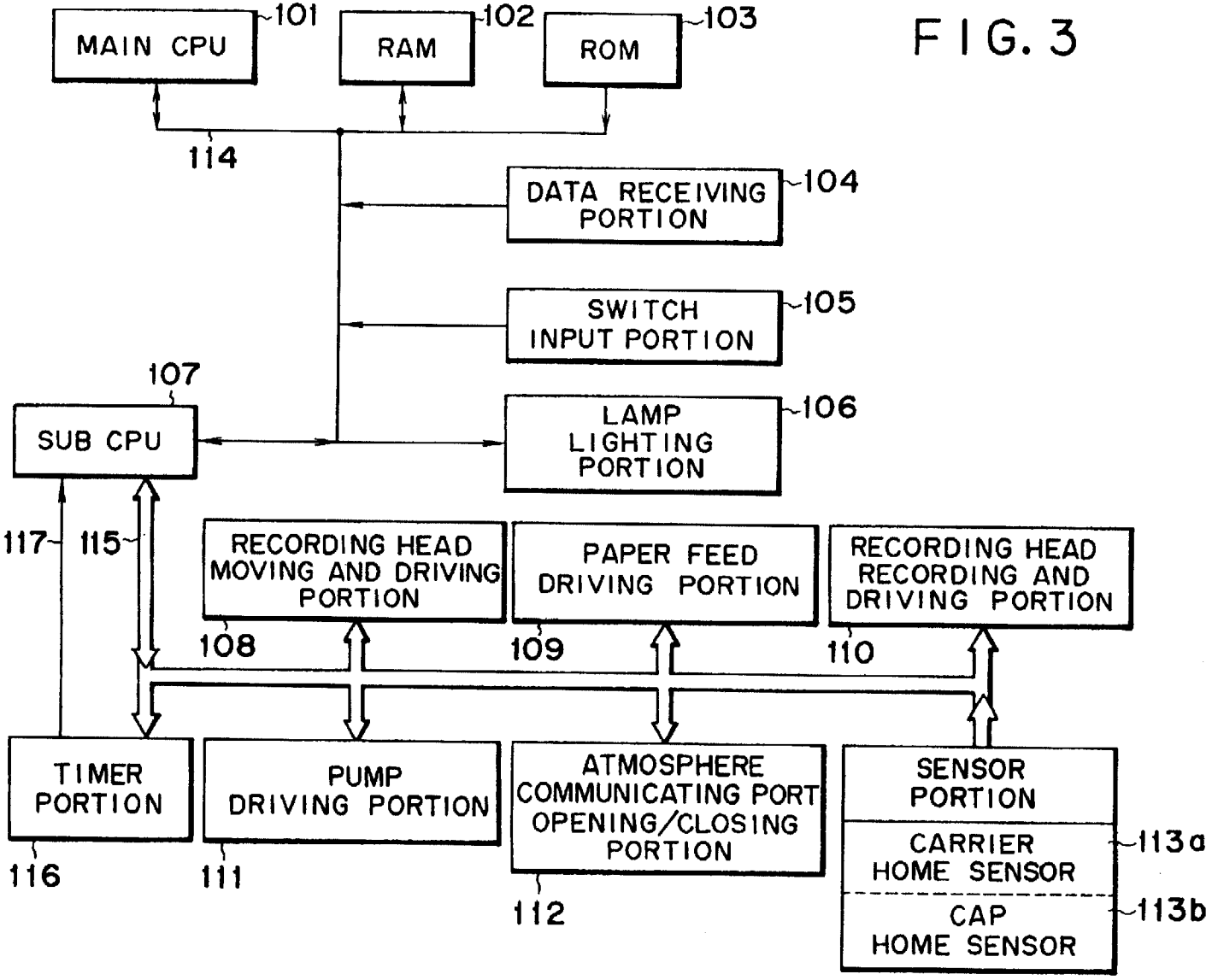
FIG. 3 is a block diagram of showing the circuit configuration of an embodiment of the ink jet recording apparatus according to the present invention.
Figure 4:
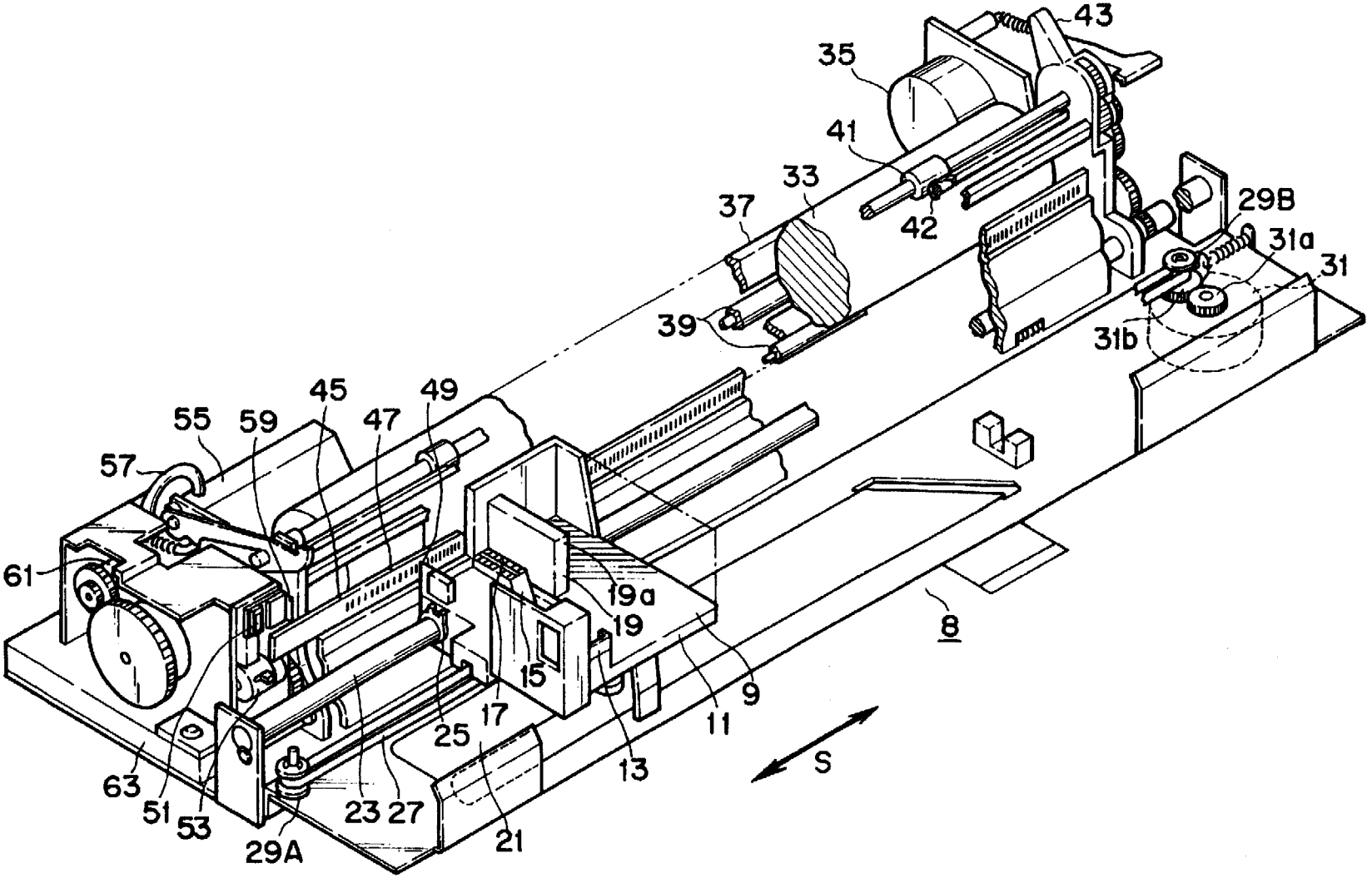
FIG. 4 is a perspective view showing the mechanical structure of the aforesaid embodiment.

FIG. 3 is a block diagram showing the circuit configuration of the embodiment of the present invention, and FIG. 4 is a perspective view showing the mechanical structure of the embodiment shown in FIG. 3.

First, the description will be made of the recorder shown in FIG. 4.

Figure 5A:
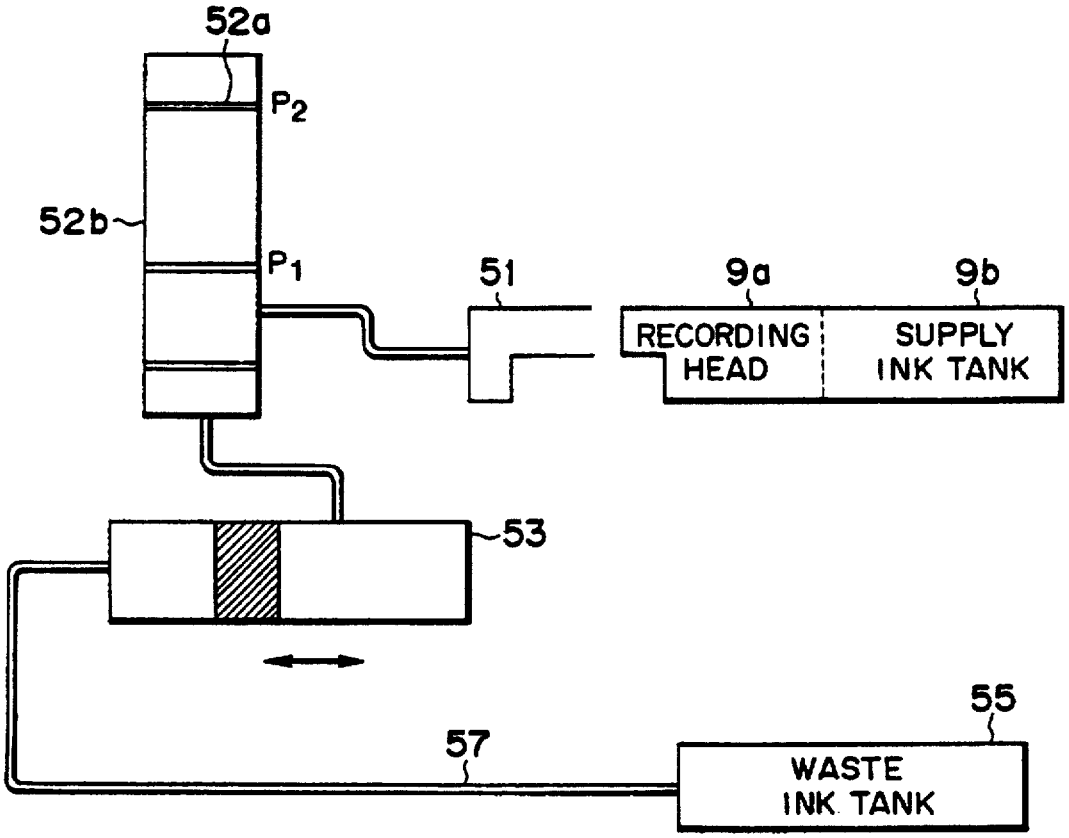
FIG. 5A is a view schematically showing the ink paths of the aforesaid embodiment.
Figure 5B:
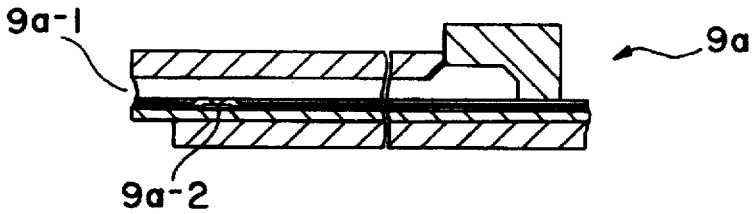
FIG. 5B is a cross-sectional view of the ink ejecting part of the recording head in FIG. 5A.

In FIG. 4, a reference numeral 9 designates a head cartridge with an ink jet recording head **9*a* (FIGS. 5A and 5B), having a supply ink tank 9*b* integrally provided therewith. A reference numeral 11 designates a carriage with this head cartridge 9 mounted thereon for scanning in the direction S in FIG. 4 (shuttling along the recording paper conveying path). A reference numeral 13 designates a hook to install the head cartridge 9 on the carriage 11; and 15, a lever for operating the hook 13. To this lever 15, a marker 17 is provided to enable the reading of the printing position or setting position of the recording head 9*a* of the head cartridge 9 by indicating the calibration provided for the cover which will be described later. A reference numeral 19 designates a supporting plate for supporting an electrical connector 19*a* for the head cartridge 9; and 21, a flexible cable for connecting the electrical connector 19*a* and the main body controller 101** (FIG. 3).

A reference numeral 23 designates a guiding axis to guide the carriage 11 in the direction S, which is inserted through a bearing 25 of the carriage 11. A reference numeral 27 designates a timing belt tensioned between the pulleys 29A and 29B arranged respectively at each end of the recorder to transmit the driving power to the carriage 11 fixed thereto to cause it to travel in the direction S. To one pulley 29B, the driving power is transmitted from a carriage motor 31 through a transmission mechanism comprising gears (**31*a* and 31*b***) and others.

A reference numeral 33 designates a platen roller for regulating the recording surface of a recording medium such as paper as well as for conveying the recording medium. The platen roller is driven by a conveying motor 35. A reference numeral 37 designates a paper pan to guide the recording medium from a paper feeding tray 4 side to the recording position; 39, a feed roller arranged on the way is the feeding path for the recording medium, which is pressed against the platen roller 33 to convey the recording medium; 41, an exhaust paper roller arranged in the downstream of the recording position toward the conveying direction of the recording medium for exhausting it to the exhaust paper outlet (not shown); 42, a spur provided against the exhaust paper roller 41 to press the roller 41 through the recording medium to cause the exhaust paper roller 41 to generate a power to convey the recording medium; and 43, a release lever to release the tensions exerted respectively on the feed roller 39, a pressure plate 45, and the spur 42.

The pressure plate 45 controls the relieving condition and others of the recording medium and is in the vicinity of the recording position to maintain its close contact with the platen roller 33. In the present invention, the ink jet recording head 9a is employed as its recording head which performs the recording by discharging ink. Therefore, the space between the ink discharging port formation surface and the recording medium is comparatively minute, and such space should precisely be controlled so as not to allow any contact to occur between the recording medium and the ink discharging port formation surface of the recording head. For this purpose, the arrangement of this pressure plate 45 is effective. A reference 47 designates a calibration provided for the pressure plate 45; and 49, a marker mounted on the carriage 11 corresponding for this calibration. With this marker, it is also possible to read the printing position or setting position of the recording head 9a.

A reference numeral 51 designates a cap made of a resilient material such as rubber, which faces the ink discharging port formation surface of the recording head 9a at the home position thereof. The cap is supported to be attachable to or detachable from the recording head 9a. This cap 51 covers the discharging ports 9a-1 of the recording head 9a at the time of its non-recording operation or the like to protect the recording head 9a. The cap is also used at the time of the discharge recovery process of the recording head 9a. Here, the discharge recovery process means that irrespective of any actual recording, ink is discharged from each of the entire discharging ports 9a-1 by driving the energy generator 9a-2 (FIG. 5B) which is provided inside the ink discharging port for generating energy to be utilized for discharging ink; thus carrying out a process (preparatory discharge) to remove from the inside of the recording head 9a the obstacles which causes the defective discharging such as bubbles, dusts, and the ink unsuitable for recording due to the increased viscosity, or aside from the preparatory discharge, to remove all possible causes of defective discharging by forcibly discharging ink from the discharging ports.

A reference numeral 53 designates a pump to exert suction for forcibly exhausting ink as well as to suck the ink accommodated in the cap 51 at the time of the discharge recovery process by such forcible ink exhaustion or the discharge recovery process by the preparatory discharge; 55, a waste ink tank for holding the waste ink collected by the suction exerted by the pump 53; and 57, a tube connecting between the pump 53 and the waste ink tank 55.

A reference numeral 59 designates a blade for wiping the discharging port formation surface of the recording head 9a, which is movably supported to travel between the position where the blade is projected to the recording head side to perform the wiping in the process of conveying the head and the retreated position where the blade is not in contact with the discharging port formation surface; 61, a motor for the recovery system; and 63, a cam arrangement for allowing the pump 53 to be driven and also the cap 51 or the blade 59 to be moved respectively by transmitting the driving power received from the recovery system motor 61.

Now, in reference to FIG. 5 schematically showing the ink path arrangement, the description will be made of the ink paths for the above-mentioned recorder shown in FIG. 4.

From the supply ink tank 9b provided in the ink cartridge 9 ink is supplied to the recording head 9a. In this respect, although the recording head 9a and the supply ink tank 9b are integrally accommodated in the ink cartridge 9 in the present embodiment, these two can be arranged as separate bodies.

Also, in a capping state, the cap 51 is in contact with the recording head 9a. Then, when ink is forcibly sucked from the recording head 9a, an atmosphere communicating port switching valve 52a is shifted to the position $P_1$ to drive the pump 53 for sucking ink from the recording head 9a into the pump 53 through the cap 51 and the atmosphere communicating port switching valve 52a. In this instance, the air system circuit is closed. Then, the ink in the pump 53 is exhausted to the waste ink tank 55 through the waste ink tube 57.

Also, in the above-mentioned capping state, if the recording head 9a has a high temperature, the air in the closed air circuit is warmed to be thermally expanded. In such a case, the atmosphere communicating port switching valve 52a is shifted to the position $P_2$ to release the expanded air to the outside through the atmosphere communicating port 52b.

Subsequently, the circuit configuration of the present embodiment will be described in reference to a block diagram shown in FIG. 3. This circuit performs the control of the recording operation and recovery operation of the recorder shown in FIG. 4 and FIGS. 5A and 5B.

In FIG. 3, a bus 114 comprising address bus, data bus, and control bus for controlling those buses is output from a central processing unit (hereinafter referred to as main CPU) 101. This bus 114 is connected to RAM 102, ROM 103, data receiving portion 104, switch input portion 105, lamp lighting portion 106, and an auxiliary processing unit (hereinafter referred to as sub CPU) 107. Also, from the sub CPU 107, a bus 115 comprising address bus, data bus, and control bus for controlling these buses is output. This bus 115 is connected to the recording head moving and driving portion 108, paper feed driving portion 109, recording head recording and driving portion 110, pump driving portion 111, atmosphere communicating port open/closing portion 112, various sensors portion 113 and timer portion 116. The timing information from the timer portion 116 is given to the sub CPU 107 by signal 117.

The main CPU 101 controls each portion in accordance with the program stored in ROM 103. The recording information transmitted from the host computer is received by the data receiving portion 104 of the recorder side. The data receiving portion 104 communicates with the host computer on receiving and transmitting data as to the data to be received or the data on the status of the recording paper and the like. The recording information received is stored in RAM 102 and is given to the sub CPU 107 as the recording instruction when the recording factors such as recording instructions and others are provided. The sub CPU 107 which has received the recording instruction performs the optimum control over the recording head moving and driving portion 108, paper feed driving portion 109, recording head recording driving portion 110, pump driving portion 111, atmosphere communicating port opening/closing portion 112 to carry out the recording while confirming the respective conditions of the various sensors portion 113.

The capping for the recording head 9a is carried out by driving the pump driving portion 111 to cause the cap 51 which is mechanically connected to the pump driving portion 111 to function.

Figure 6:
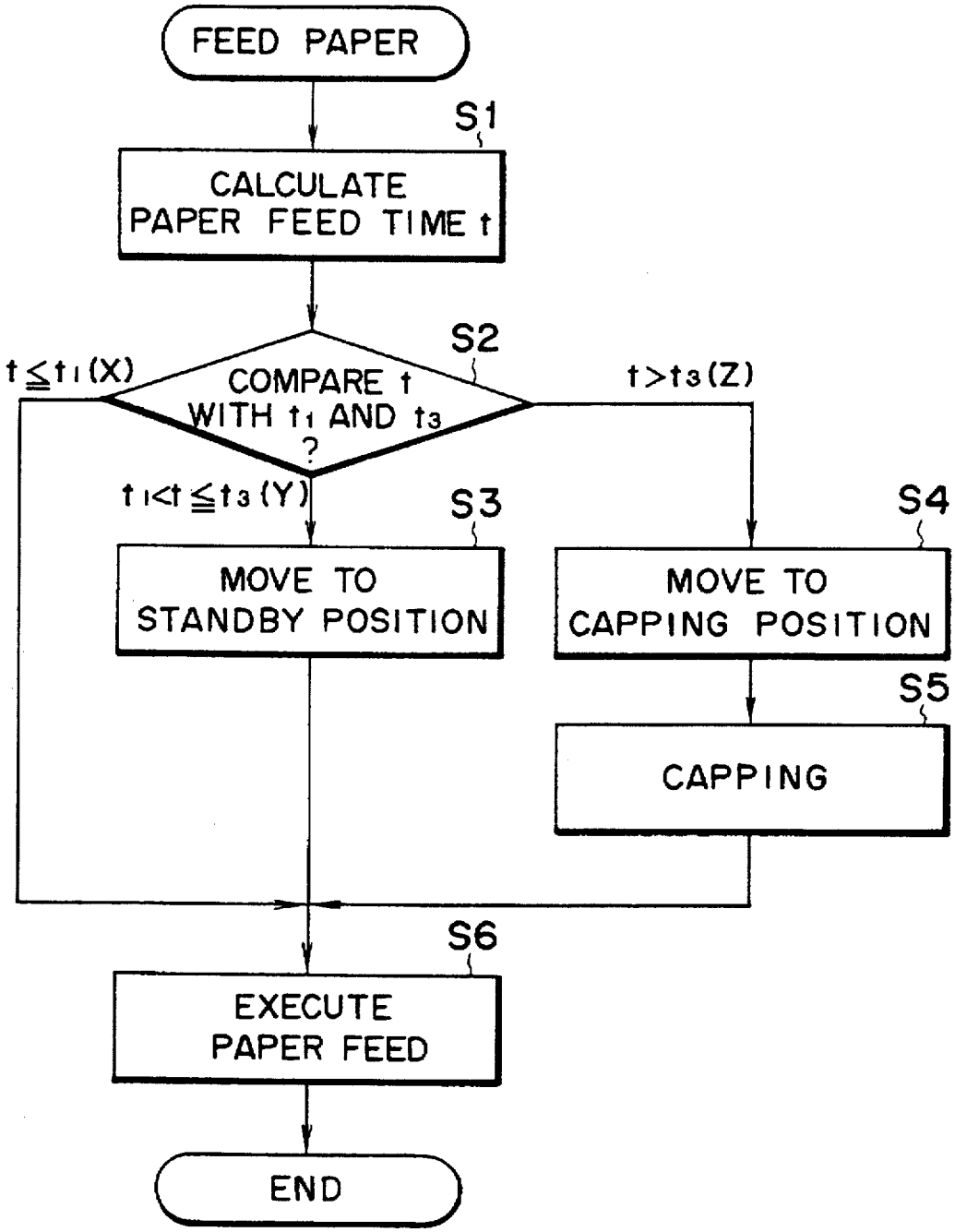
FIG. 6 is a flowchart illustrating the operation of the aforesaid embodiment.

Now, in reference to a flowchart shown in FIG. 6, the paper feeding operation of the present embodiment will be described.

The sub CPU 107 having received the recording instruction from the main CPU 101 analyzes the content of the recording instruction. A recording instruction consists of the recording information and paper feeding information, and the sub CPU 107 works out the time t required for feeding the paper based on the aforesaid paper feeding information. This paper feeding time t is worked out on the judgement, computation or descrimation of the number of paper feeding pulses contained in the paper feeding information provided by the main CPU 101.

Figure 1:
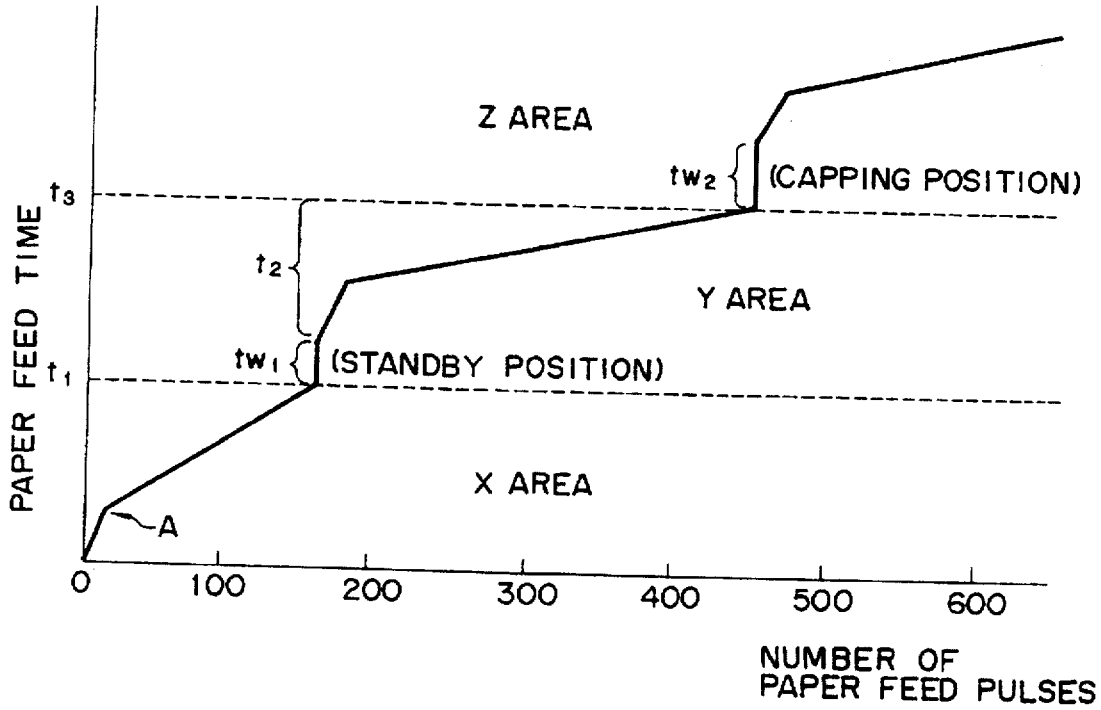
FIG. 1 is a graph illustrating the operation of an ink jet recording apparatus.
Figure 2:
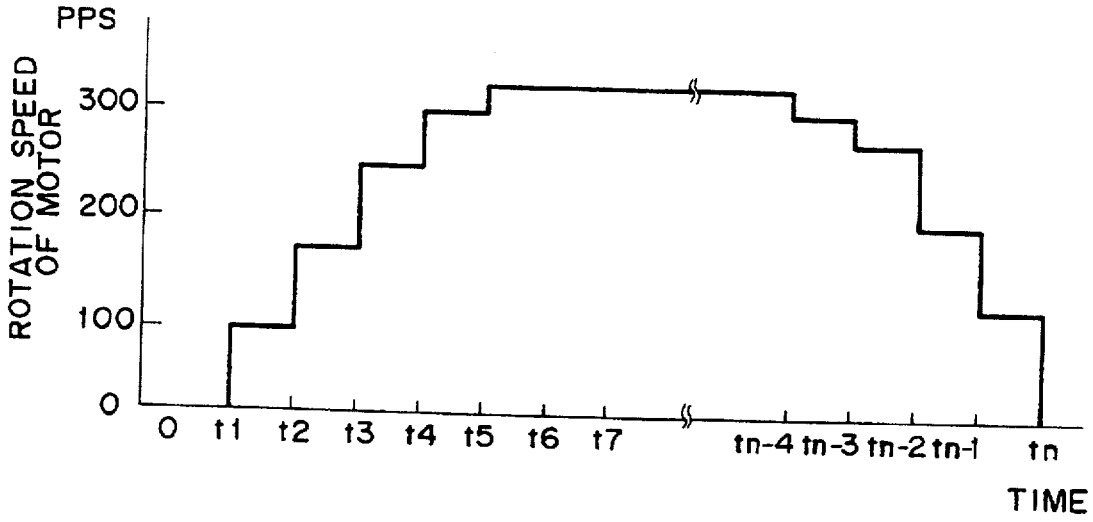
FIG. 2 is a graph illustrating the operation of a motor.

Then, referring to the correlation diagram shown in FIG. 1, the sub CPU 107 judges to which of X, Y, and Z areas, the paper feeding time belongs (steps S1 and 2). For example, if the number of the paper feeding pulses is 180 or less, the time is judged as belonging to the area $t \leqq t_1$ (X area); if 450 or less, $t_1 < t \leqq t_3$ (Y area); and if the number exceeds this, then $t > t_3$ (Z area). Here, in this respect, a paper feed of 1/360 inches is carried out per paper feeding pulse.

Subsequently, based on the paper feeding time thus worked out, the retraction control of the recording head 9a is performed if such control is necessary to retract the recording head 9a. In other words, if the retraction operation is needed for the recording head 9a in the course of the paper feeding, the recording head portion 108 is driven to cause the recording head 9a to be retracted to a predetermined position. For example, if the paper feeding time belongs to the aforesaid Y area, the recording head 9a is conveyed to the standby position at the step S3. Also, if the paper feeding time belongs to the Z area, the recording head 9a is conveyed to the capping position at the step S4. This conveyance of the recording head 9a to the capping position is confirmed by a carrier home sensor 113a in the various sensors portion 113. Then, at the step S5, the pump driving portion 111 is controlled to perform the capping by allowing the cap 51 interlocked therewith to be operated. This capping operation is confirmed by a cap home sensor 113b in the various sensors portion 113 if normally executed.

Then, at the step S6, the paper feed driving portion 109 is controlled to execute the paper feeding in a specific amount in accordance with the volume of paper feed required.

In this respect, the retractive operation of the recording head 9a is carried out as in the conventional system if it is not engaged in any operation other than the paper feeding. In such a case, the timing information is provided by the signal 117 from the timer portion 116. Also, in a state where ink is not discharged from the recording head, the feed amount of the recording medium and the time required for feeding the recording medium and the like should be taken into account as a volume by which the aforesaid recording medium should be fed relatively to the aforesaid recording head.

Figure 7A:
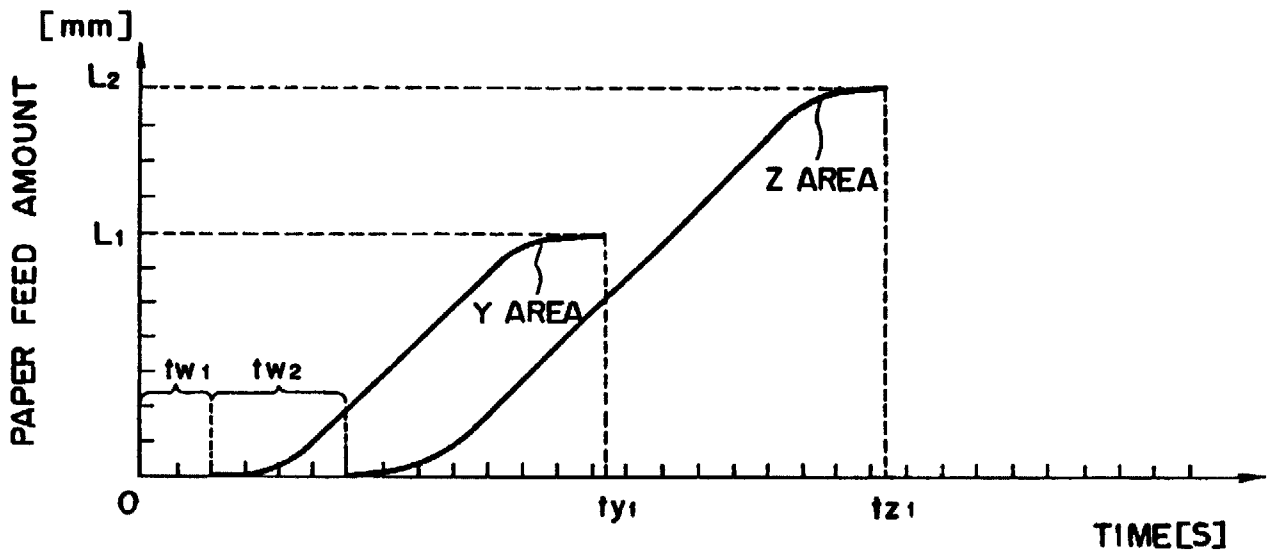
FIGS. 7A and 7B are graphs illustrating the operation of the aforesaid embodiment.

FIG. 7A shows a graph illustrating the relationship between the amount of the paper feeding and the time required for the paper feeding in the case of the retraction control in the present embodiment. In this respect, a graph for the retraction control in a conventional example is shown in FIG. 7B, and as shown in FIGS. 7A and 7B, it is clear that as compared with the conventional example, the recording speed of the present embodiment has been improved.

Figure 7B:
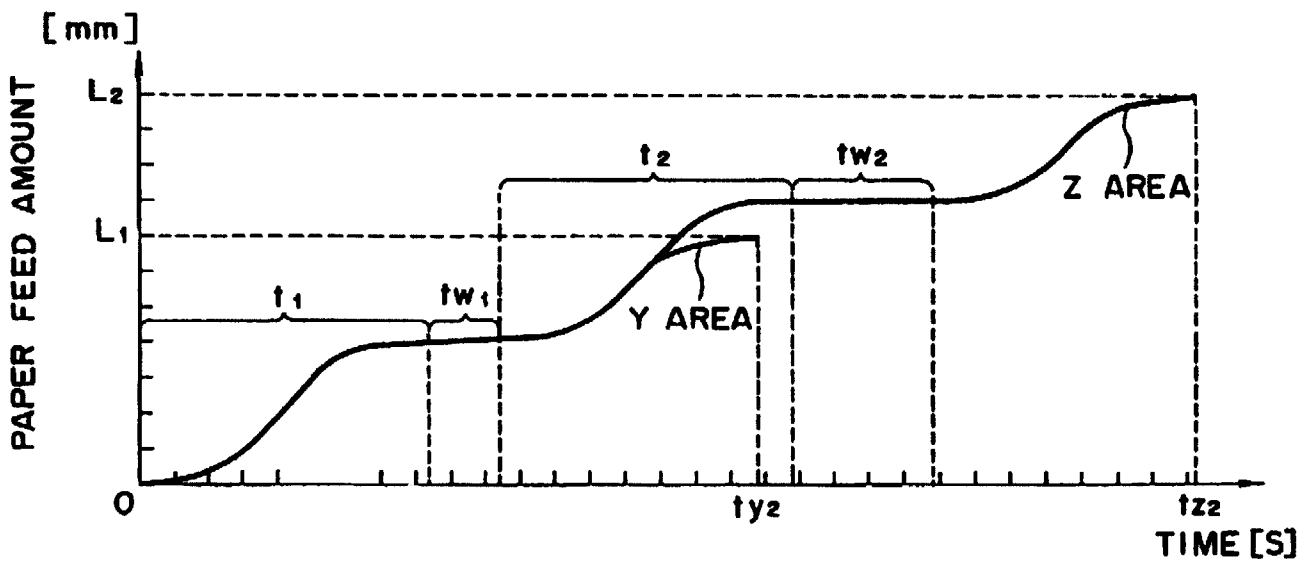

Now, in FIGS. 7A and 7B, a reference mark $tw_1$ designates the time required for suspending the paper feeding to convey the recording head 9a to the standby position; and $tw_2$, the time required for conveying the recording head 9a from the standby position to the capping position to carry out the capping. Further, a reference mark $t_1$ designates the time for feeding paper in a state where the recording head 9a still remains on the recording paper; and $t_2$, the time for feeding paper in a state where the recording head 9a stays at the standby position.

In a case where the paper feeding is executed in the Y area for the amount $L_1$, the paper feeding time is $tY_1$ according to the control by the present embodiment whereas it requires the time $tY_2$ ($>tY_1$) in the conventional example. Also, in the case of controlling the paper feeding in the Z area for the amount $L_2$, the paper feeding time is $tz_1$ by the present embodiment whereas it requires the time $tz_2$ ($>tz_1$) in the conventional example. As the above describes, the time required for feeding the paper is shortened by the present embodiment to improve the recording speed.

Also, in the conventional example, the paper feeding is carried on for the period of time $t_1$ with the recording head 9a remaining on the recording paper. As a result, there is a possibility that the defective ink discharging is brought about due to the adhesion of the dusts of paper particles and others to the recording head 9a. However, in the present embodiment, the paper feeding is carried on while the recording head stays retractively outside the recording area. It is therefore possible to avoid such situation that may cause the defective ink discharging.

Also, in the above-mentioned embodiment, the description has been made of the case where the two positions, the standby position and the capping position, are provided for the recording head to stay at for its retraction. Such retracting position may be set for only one or three or more positions. The method of protecting the recording head is not necessarily limited to the capping, either.

Furthermore, the present invention produces an excellent effect on ink jet recording apparatus, particularly, on an ink jet recording apparatus which utilizes thermal energy for discharging ink from its discharging ports because, with a method such as this, it is possible to implement the recording in a higher density with a higher definition.

The typical structure and principle of this method have been disclosed in the specifications of U.S. Pat. No. 4,723,129 and U.S. Pat. No. 4,740,796, for example, and for such method, it is desirable to apply the fundamental principle disclosed therein. This method is applicable both to the so-called on-demand type and continuous type. Particularly, in the case of the on-demand type, at least one driving signal, capable of providing the recording liquid (ink) with a rapid temperature rise which exceeds the nucleate boiling, is applied in response to the recording information to the electrothermal converter arranged against a sheet containing the recording liquid therein or in the liquid path; thus causing the electrothermal converter to generate the thermal energy for film-boiling the recording liquid in the vicinity of the thermally functioning surface of the recording head. Then, a bubble is formed effectively in the recording liquid (ink) one to one in response to the aforesaid driving signal. The recording liquid (ink) is discharged into the atmosphere through the discharging port by the active power generated in the course of the growth and contraction of this bubble to form at least one droplet. It should be more desirable to produce this driving signal in a form of pulses because in that way the growth and contraction of bubbles can be effectuated instanteneously and appropriately so that the discharging of the liquid (ink) is implemented with an excellent responsiveness.

According to the present invention, the retraction of the recording means to the outside of the recording area is controlled in accordance with the conveying time of the recording medium. Therefore, there is no possibility that the recording speed is slowed down due to any unnecessary retraction operation, and further, it is possible to prevent any defective discharging caused by the dusts of paper particles and the like.

I claim:

1. An ink jet recording apparatus for use with recording means for recording by discharging ink onto a recording medium within a recording area, said apparatus comprising:

conveying means for conveying the recording medium;

means for discriminating an amount of conveyance the recording medium is to be conveyed relative to said recording means;

means for converting the amount of conveyance the recording medium is to be conveyed into a time the recording medium is to be conveyed;

means for mounting said recording means;

means for retracting said mounting means, on which said recording means is mounted;

capping means for capping said recording means; and controlling means for communicating with and controlling said conveying means, converting means and capping means, wherein if a converted time corresponding to a result of the discrimination is more than a predetermined time period, said controlling means controls a capping operation to be performed by said capping means for said recording means subsequent to retraction of said recording means to outside of the recording area by said retracting means.

2. A recording apparatus according to claim 1, wherein the amount of conveyance the recording medium is to be conveyed relative to said recording means is based on a distance the recording medium is to be moved with respect to said recording means.

3. A recording apparatus according to claim 1, wherein the amount of conveyance the recording medium is to be conveyed relative to said recording means is discriminated by said discriminating means based on a number of paper feeding pulses instructed by a main CPU to a sub CPU, which communicates with the main CPU.

4. A recording apparatus according to claim 1, wherein if the converted time corresponding to the result of the discrimination is equal to or less than another predetermined time period which is less than the predetermined time period, said controlling means controls said retracting means not to retract said recording means to the outside of the recording area.

5. A recording apparatus according to claim 1, wherein if the converted time corresponding to the result of the discrimination is more than another predetermined time period which is less than the predetermined period, and the converted time corresponding to the result is equal to or less than the predetermined time period, said controlling means controls said retracting means to retract said recording means to the outside of the recording area.

6. A recording apparatus according to claim 1, wherein said recording means comprises an ink jet recording head for discharging ink from a discharging port, said recording head comprising electrothermal converting means for generating thermal energy to heat the ink and change a state of the ink.

7. A recording apparatus according to claim 1, wherein said recording means comprises a discharging port and an electrothermal converter which generates thermal energy to form bubbles by film-boiling ink with the thermal energy and the ink is discharged from said discharging port in response to the bubbles.

8. An ink jet recording apparatus for use with recording means for recording by discharging ink onto a recording medium within a recording area, said apparatus comprising:

mounting means for mounting said recording means;

computing means for computing a conveying amount in which the recording medium is to be moved relative to said recording means in a mode where ink is not discharged from said recording means;

means for converting the conveying amount into a conveying time;

retracting means for effecting a retracting operation of said mounting means, on which said recording means is mounted, to outside of the recording area;

means for protecting said recording means, said protecting means being provided outside the recording area for capping a discharge port for discharging ink to record on the recording medium; and controlling means for communicating with and controlling said retracting means, converting means and protecting means, wherein said controlling means controls said retracting means such that said recording means is in a standby mode in which said recording means is not retracted if a conveying time corresponding to a conveying amount computed by said computing means is equal to or less than a first predetermined time period, controls said retracting means such that said recording means is retracted to the outside of the recording area in the standby mode if the conveying time corresponding to a conveying amount exceeds the first predetermined time period but is equal to or less than a second predetermined time period, and controls said retracting means and said protecting means such that said recording means is in the standby mode outside the recording area while being protected by said protecting means if the conveying time corresponding to a conveying amount is greater than the second predetermined time period.

9. A recording apparatus according to claim 8, wherein said recording means is provided with a plurality of discharging ports which discharge ink, and thermal energy generating means arranged to correspond with each of the discharging ports for causing ink to change state by heat and form ink droplets by discharging the ink from said discharging ports based on the change of state.

10. A recording apparatus according to claim 8, wherein the conveying amount in which the recording medium is to be moved relative to said recording means is based on a distance the recording medium is to be moved with respect to said recording means.

11. A recording apparatus according to claim 8, wherein the conveying amount in which the recording medium is to be moved relative to said recording means is computed by said computing means based on a number of paper feeding pulses instructed by a main CPU to a sub CPU, which communicates with the main CPU.

12. An ink jet image forming apparatus for forming an image by discharging ink from an ink discharge port of a head to an image forming medium conveyed by a conveying mechanism, said apparatus comprising:

a capping mechanism for capping said ink discharge port, said capping mechanism being located outside of an image forming area for forming an image on the image forming medium;

calculating means for calculating a conveyance time required to convey the image forming medium with said conveying mechanism; and controlling means for controlling the head and said conveying mechanism to convey the image forming medium by said conveying mechanism when the calculated conveyance time is equal to or less than a first predetermined time, to convey the image forming medium by said conveying mechanism after said head is moved to a standby position outside of the image forming area when the calculated conveyance time is more than the first predetermined time and equal to or less than a second predetermined time, and to move said head to a capping position outside of the image forming area and to convey the image forming medium by said conveying mechanism when the calculated conveyance time is more than the second predetermined time.

13. An apparatus according to claim 12, wherein said head comprises an ink jet recording head for discharging ink from the ink discharge port, the recording head comprising electrothermal converting means for generating thermal energy to heat the ink and change a state of the ink.

14. An apparatus according to claim 12, wherein said head comprises said ink discharge port and an electrothermal converter which generates thermal energy to form bubbles by film-boiling ink with the thermal energy and the ink is discharged from said discharge port in response to the bubbles.

15. An ink jet image forming method for forming an image by discharging ink from an ink discharge port of a head to an image forming medium conveyed by a conveying mechanism, said method comprising the steps of:

forming an image on the medium with the head;

calculating a conveyance time required to convey the image forming medium with the conveying mechanism; and controlling the head and the conveying mechanism to convey the image forming medium by the conveying mechanism when the calculated conveyance time is equal to or less than a first predetermined time, to convey the image forming medium by the conveying mechanism after the head is moved to a standby position outside of the image forming area when the calculated conveyance time is more than the first predetermined time and equal to or less than a second predetermined time, and to move the head to a capping position to be capped by a capping mechanism outside of the image forming area and to convey the image forming medium by the conveying mechanism when the calculated conveyance time is more than the second predetermined time.

16. A method according to claim 15, wherein the head comprises an ink jet recording head for discharging ink from the ink discharge port, the recording head comprising electrothermal converting means for generating thermal energy to heat the ink and change a state of the ink.

17. A method according to claim 15, wherein the head comprises the ink discharge port and an electrothermal converter which generates thermal energy to form bubbles by film-boiling ink with the thermal energy and the ink is discharged from the discharge port in response to the bubbles.

18. An ink jet recording apparatus for use with recording means for recording by discharging ink onto a recording medium within a recording area, said apparatus comprising:

conveying means for conveying the recording medium;

means for discriminating an amount of conveyance the recording medium is to be conveyed relative to said recording means;

means for determining a time the recording medium is to be conveyed based on the amount of conveyance of the recording medium discriminated by said discriminating means;

a carriage for mounting said recording means;

means for moving said carriage, on which said recording means is mounted;

capping means for capping said recording means at a capping position; and controlling means for communicating with and controlling said conveying means, determining means, moving means and capping means, wherein said controlling means controls said moving means to move said carriage not located at said capping position to said capping position when the time period determined by said determining means exceeds a predetermined time period.

19. A recording apparatus according to claim 18, wherein the amount of conveyance the recording medium is to be conveyed relative to said recording means is based on a distance the recording medium is to be moved with respect to said recording means.

20. A recording apparatus according to claim 18, wherein the amount of conveyance the recording medium is to be conveyed relative to said recording means is discriminated by said discriminating means based on a number of paper feeding pulses instructed by a main CPU to a sub CPU, which communicates with said main CPU.

21. A recording apparatus according to claim 18, wherein if the determined time corresponding to the result of the discrimination is equal to or less than another predetermined time period which is less than the predetermined time period, said controlling means controls said moving means not to move said carriage outside of the recording area.

22. A recording apparatus according to claim 18, wherein if the determined time corresponding to the result of the discrimination is more than another predetermined time period which is less than the predetermined time period, and the determined time corresponding to the result is equal to or less than the predetermined time period, said controlling means controls said moving means to move said carriage outside of the recording area.

23. A recording apparatus according to claim 18, wherein said recording means comprises a discharging port and an electrothermal converter which generates thermal energy to form bubbles by film-boiling ink with the thermal energy and the ink is discharged from said discharging port in response to the bubbles.

24. A recording apparatus according to claim 18, wherein said recording means comprises an ink jet recording head for discharging ink from a discharging port, said recording head comprising electrothermal converting means for generating thermal energy to heat the ink and change a state of the ink.

25. An ink jet recording method for use with recording means for recording by discharging ink onto a recording medium within a recording area, said method comprising the steps of:

conveying the recording medium;

discriminating an amount of conveyance the recording medium is to be conveyed relative to the recording means;

determining a time the recording medium is to be conveyed based on the discriminated amount of conveyance of the recording medium;

mounting the recording means on a carriage;

moving the carriage, on which the recording means is mounted;

capping the recording means at a capping position; and controlling movement of the carriage such that said carriage will be moved to the capping position when the determined time period exceeds a predetermined time period.

26. A recording method according to claim 25, wherein the amount of conveyance the recording medium is to be conveyed relative to the recording means is based on a distance the recording medium is to be moved with respect to the recording means.

27. A recording method according to claim 25, wherein the amount of conveyance the recording medium is to be conveyed relative to the recording means is discriminated in said discriminating step based on a number of paper feeding pulses instructed by a main CPU to a sub CPU, which communicates with the main CPU.

28. A recording method according to claim 25, wherein if the determined time corresponding to the result of the discrimination is equal to or less than another predetermined time period which is less than the predetermined time period, the carriage is controlled to not move outside of the recording area.

29. A recording method according to claim 25, wherein if the determined time corresponding to the result of the discrimination is more than another predetermined time period which is less than the predetermined period, and the determined time corresponding to the result is equal to or less than the predetermined time period, the carriage is controlled to move outside of the recording area.

30. A recording method according to claim 25, wherein the recording means is provided with a discharging port and an electrothermal converter which generates thermal energy to form bubbles by film-boiling ink with the thermal energy and the ink is discharged from the discharging port in response to the bubbles.

31. A recording method according to claim 25, wherein the recording means is provided with an ink jet recording head for discharging ink from a discharging port, the recording head comprising electrothermal converting means for generating thermal energy to heat the ink and change a state of the ink.

* * * * *

UNITED STATES PATENT AND TRADEMARK OFFICE

CERTIFICATE OF CORRECTION

PATENT NO. : 5,701,145

DATED : December 23, 1997

INVENTOR(S) : Takayuki NINOMIYA

It is certified that error appears in the above-identified patent and that said Letters Patent is hereby corrected as shown below:

ON THE COVER PAGE

AT [57] ABSTRACT:

Line 7, "area" should read --area and capped--.

Signed and Sealed this

Sixteenth Day of June, 1998

*Attest:*

Bruce Lehman

BRUCE LEHMAN

*Attesting Officer*

*Commissioner of Patents and Trademarks*